United States Patent [19]

Olney et al.

[11] 4,138,281

[45] Feb. 6, 1979

[54] PRODUCTION OF EXPLOSIVE EMULSIONS

[76] Inventors: Robert S. Olney, Bethlehem; Charles G. Wade, Lehighton, both of Pa.

[21] Appl. No.: 848,670

[22] Filed: Nov. 4, 1977

[51] Int. Cl.[2] ..... C06B 45/00

[52] U.S. Cl. ..... 149/2; 149/44; 149/46; 149/109.6

[58] Field of Search ..... 149/2, 109.6, 44, 46

[56] References Cited

U.S. PATENT DOCUMENTS 3,765,964 10/1973 Wade ..... 149/2

3,794,534 2/1974 Chandler ..... 149/2

*Primary Examiner*—Stephen J. Lechert, Jr.

*Attorney, Agent, or Firm*—Richards, Harris & Medlock

[57] ABSTRACT

A process and apparatus for preparing cap sensitive water-in-oil explosive emulsion compositions on a commercial basis is provided which includes mixing a hydrocarbon fuel component, an emulsifier, and an aqueous inorganic oxidizing salt solution under mixing conditions sufficient to obtain an emulsion matrix coposition and thereafter blending microbubbles with the emulsion matrix, the microbubbles being introduced to the emulsion matrix from a deaerated reservoir thereof.

12 Claims, 1 Drawing Figure

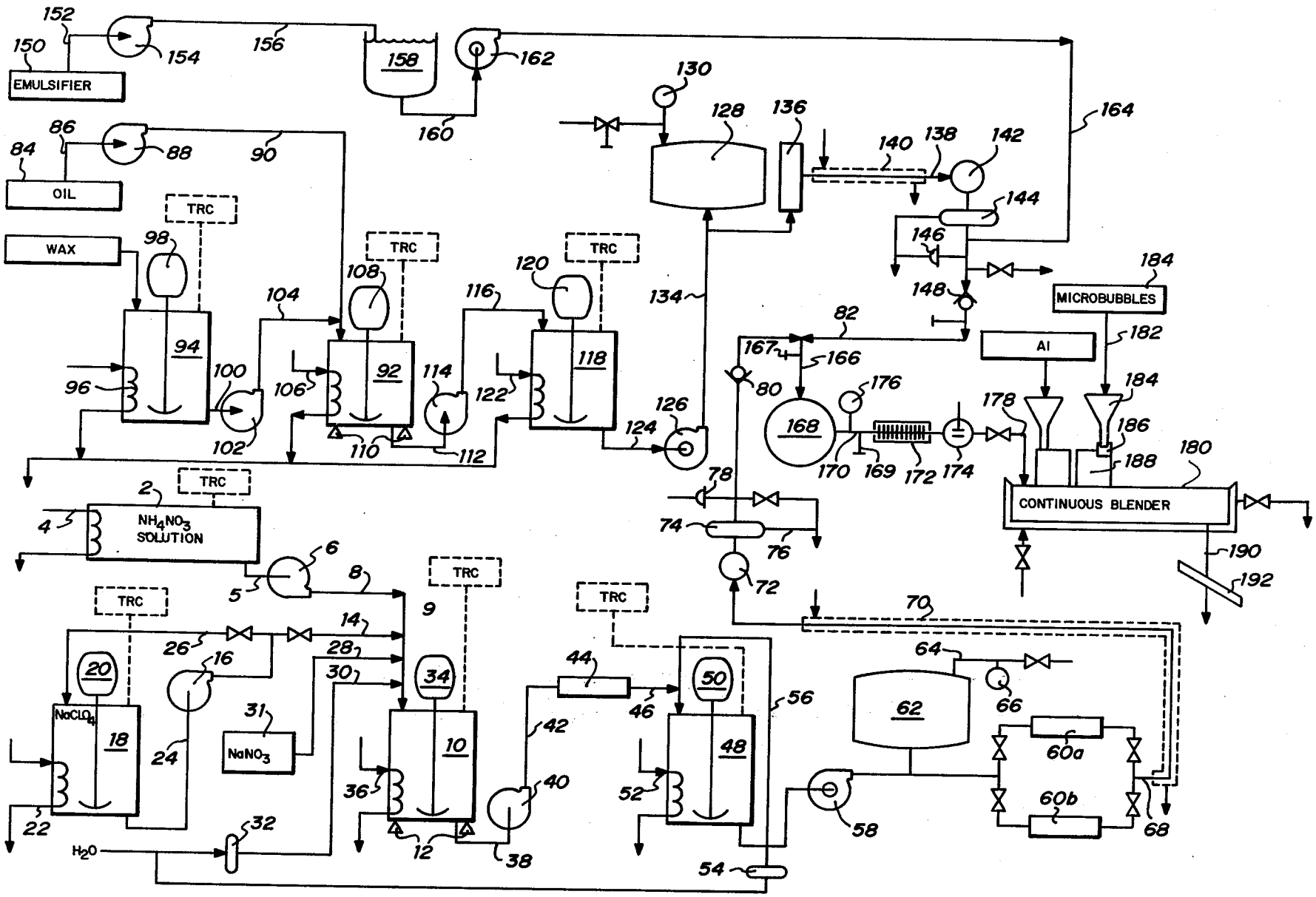
CONTINUOUS BLENDER
MICROBUBBLES
AI
EMULSIFIER
OIL
WAX
TRC
$NH_4NO_3$ SOLUTION
$NaNO_3$
$NaClO_4$
$H_2O$

PRODUCTION OF EXPLOSIVE EMULSIONS

BACKGROUND OF THE INVENTION

In one aspect, the present invention relates to a process for preparing water-in-oil explosive emulsion compositions. In another aspect, the present invention relates to apparatus for the continuous production of cap sensitive or blasting agent water-in-oil explosive emulsion compositions on the commercial level. In still a further aspect, the present invention relates to a process for manufacturing explosive emulsion compositions including safety and quality control features further described hereinbelow.

Emulsion explosive compositions have recently obtained wide acceptance in the explosive industry because of their excellent explosive properties and ease of use in various applications. Until recently, water-in-oil explosives generally comprised blasting agents requiring a booster in order to effect their detonation. These emlsion type blasting agents were first disclosed by Bluhm in U.S. Pat. No. 3,447,978. While such emulsion type blasting agents have many advantages over other water slurry type blasting agents they are not cap sensitive. Cap sensitive emulsion explosives have been prepared in the past by the addition of an explosive ingredient or a specific detonation catalyst. Examples of these types of cap sensitive emulsion explosives are described in U.S. Pat. No. Re. 28,060. U.S. Pat. No. 3,770,522 and U.S. Pat. No. 3,765,964.

Recently it has been discovered that a cap sensitive water-in-oil emulsion explosive composition, which can be detonated with a No. 6 cap at diameters of 1.25" and lower, which does not contain an explosive ingredient or a detonation catalyst can be formulated by employing closed cell void containing materials, such as microbubbles fabricated from saran or glass, with specific proportions of a hydrocarbon fuel component, an emulsifier, water, inorganic oxidizing salts, and optionally, an auxiliary fuel, such as aluminum. These cap sensitive water-in-oil explosive compositions are described in detail in U.S. patent application Ser. No. 740,094 filed Nov. 9, 1977.

Processes for preparing occluded air sensitized water-in-oil emulsion blasting agents, which are noncap sensitive, as well as cap sensitive compositions are known in the prior art. Such processes have a limited disadvantage in that because the products depend on occluded air for sensitization, process conditions when admixing the aqueous oxidizing salt solutions thereof with the hydrocarbon fuel component thereof must be closely controlled. Temperature conditions within such processes must be regulated such that the aqueous oxidizing salt solution does not reach a temperature so low so as to cause crystallization and salting out of the inorganic oxidizing salts in the solution. However, the process must be operated at temperatures low enough such that the hydrocarbon fuel components, employed as the oil phase of the water-in-oil emulsion, are sufficiently congealed so as to provide for occlusion of air therein.

The process for preparation of water-in-oil emulsion explosive compositions which are cap sensitive such as those described above and disclosed in U.S. application Ser. No. 740,094 does not require that the hydrocarbon fuel component be at a congealing temperature since these explosive emulsion compositions do not rely upon occluded air for sensitization. However, water-in-oil explosive compositions which are cap sensitive present a higher hazard, from a production standpoint, since the increased sensitivity increases the risk of inadvertent detonation of the compositions during processing.

Therefore, a relatively safe and efficient method for producing cap sensitive water-in-oil explosive emulsions on a commercial scale is desirable and such a process presents problems of a different nature than those overcome by prior art processes dealing with the production of occulded air sensitized emulsion explosive compositions.

SUMMARY OF THE INVENTION

According to the invention, an improved method for the production of water-in-oil explosive compositions which can be detonated with a No. 6 cap at diameters of 1.25" and lower and which do not contain an explosive ingredient or detonation catalyst is provided. These explosive emulsion compositions as well as microbubble containing noncap-sensitive water-in-oil emulsion blasting agents can be prepared as described below. The process and apparatus described herein is capable of producing such explosive compositions on a commercial basis in a manner providing for strict control of product quality and optimum safety during processing.

Basically, the process of the subject invention includes forming two premixes, one comprising an aqueous solution of inorganic oxidizing salts, and the second comprising hydrocarbon fuel components, which provide the oil phase of the water-in-oil emulsion explosive composition, and mixing, on a continuous basis, these two premixes with an appropriate amount of an emulsifier to form an emulsion matrix composition. The aqueous solution of oxidizing salts is heated to a temperature above the crystallization point of the solution and is maintained at that temperature, usually about 185 degrees F or greater, until the emulsion matrix is formed. The hydrocarbon fuel components are also heated to approximately the same temperature so as to avoid a rapid temperature drop upon admixture with the aqueous oxidizer solution. The emulsifier is added to the system in a manner such that the heat of the fuel and oxidizer solution does not cause it to degrade prior to formation of the emulsion matrix. The emulsion matrix is formed by subjecting the hydrocarbon fuel component, the aqueous solution of inorganic oxidizing salts and the emulsifier to mixing conditions sufficient to obtain emulsifying shear rates within the mixer. The term "emulsifying shear rates" as employed herein is defined to mean shear conditions at least equal to those obtained when the above-described components are mixed in a continuous recycle mixer (further described below) at pressures of from about 10 to about 80 psig and preferable of from about 35 to about 40 psig, residence times of about 4.5 seconds, and typical impeller speeds of at least about 1400 rpm (based on the use of a continuous recycle mixer having a 6" impeller diameter.) The emulsion matrix prepared in this manner is fed on a continuous basis to a paddle or ribbon type continuous blender where glass or resin microbubbles, and, if desired, an auxiliary fuel such as particulare aluminum, are blended therewith to form the cap sensitive water-in-oil explosive compositions. Noncap-sensitive explosive emulsions can also be produced by varying the composition of the explosive emulsion such as, for example, lowering the amount of microbubbles employed. It has been discovered that in order to obtain products of uniform composition the microbubbles must be fed to the continuous blender from a reservoir thereof containing a quantity of deaerated microbubbles. As further described below, microballons because of their peculiar shape, low density and flow characteristics are difficult to measure and add in a predetermined fashion if the microbubbles have been mixed with the normal amount of air which will come in contact therewith during handling and delivery to the blender.

The above process can be conveniently carried out on a commercial scale by employing an oxidizing solution production line for forming, filtering and metering the oxidizer solution to the continuous recycle mixer (or equivalent mixers), and a hydrocarbon fuel production line for similarly handling the oil phase of the water-in-oil emulsion explosive. After admixture of the two premixes to form an emulsion matrix, an emulsion matrix processing line can be employed to obtain the cap sensitive explosive compositions ready for packaging.

Another aspect of the present invention involves the use of a detonation trap located between the continuous recycle mixer which forms the emulsion matrix composition and the blender wherein microbubbles and particulate aluminum are blended with the emulsion matrix to produce the cap sensitive emulsion compositions. Basically, the detonation trap comprises a piece of flexible conduit located between the mixer and the blender such that any conflagration which may be initiated in the mixer will not be transmitted to the cap sensitive materials being produced in the blender down stream thereof.

Various other functions and advantages of the process and apparatus of the present invention will be apparent from a study of the drawing which depicts a schematic representation of one embodiment of the process of the present invention as well as from a study of the detailed description contained hereinbelow.

DETAILED DESCRIPTION OF THE INVENTION

Now referring to the drawing a preferred embodiment of the process of the subject invention will be described in relation thereto. The aqueous solution of inorganic oxidizing salts will contain at least 64% by weight inorganic oxidizing salts selected from the group consisting of ammonium nitrate, alkali and alkaline earth metal nitrates and perchlorates. Normally ammonium nitrate will comprise at least about 53% by weight of the solution. The aqueous solution of inorganic oxidizing salts can be prepared in a production line manner as follows. A reservoir tank 2 of an aqueous ammonium nitrate solution comprising from about 80% to about 97% by weight of ammonium nitrate and preferably about 93% by weight of ammonium nitrate is kept heated (above the saturation temperature) at temperatures of from about 180 degrees F to about 290 degrees F by appropriate heat supplying means such as steam coils 4. Normally it is desirable to maintain temperatures high enough throughout the system so that crystallization of the concentrated inorganic oxidizing salts in the aqueous solution is prevented. The ammonium nitrate solution is pumped by an outlet conduit 5 through pumping means 6 to oxidizer makeup tank 10 via conduits 8 and 9. An aqueous solution of sodium perchlorate can also be added to oxidizer makeup tank 10 via conduits 14 and 9 and pumping means 16. Since the sodium perchlorate solution concentrations required are not usually commercially available, a sodium perchlorate makeup tank 18 can be provided with suitable agitation means 20 which can comprise a stirrer and electric drive means, and a heat supply such as steam coils 22. The sodium perchlorate solution can be pumped via outlet conduit 24 and pumping means 16 into the oxidizer makeup tank 10 as described above. Sodium perchlorate recycle conduit 26 can be employed to recycle excess portions of sodium perchlorate solution back to sodium perchlorate makeup tank 18 and thereby provide additional agitation. In addition, solid sodium nitrate may be added to oxidizer makeup tank 10 either manually or via conduits 28 and 9 from sodium nitrate holding bin 31 by any number of conventional solid feed conveying means, such as screw conveyors and the like. If water is necessary in order to adjust the concentration of the inorganic oxidizing salt solution, water conduit 30 can supply same in a controlled manner via water metering means 32.

Load cells 12, upon which oxidizing makeup tank 10 rests, automatically sense, by weight, the amount of oxidizing salt solution present in oxidizer makeup tank 10 and automatically provide for shutdown of the pumping means 6 and 16 connected thereto when the predetermined amount of oxidizer solution has been deposited in makeup tank 10. Load cells 12 can also be employed to control the flow of solid ammonium nitrate. Oxidizer makeup tank agitation means 34 insures that a homogeneous solution of the various inorganic oxidizing salts is prepared in oxidizer makeup tank 10. Heating means such as steam coils 36 are employed in order to keep the inorganic oxidizing solution at approximately 190 degrees F, or above the crystallization temperature of the particular oxidizing salt solution. The temperatures in the ammonium nitrate solution holding tank 2, the sodium perchlorate makeup tank 18, and the oxidizer solution makeup tank 10 can be controlled by providing a number of automatic temperature recording and control means (TRC) depicted schematically in the drawing.

The inorganic oxidizing salt solution is pumped from oxidizer makeup tank 10 via outlet conduit 38, pumping means 40 and conduit 42, where filter means 44, which can comprise screen or fabric type filtering devices, removes any particulate contaminates and inorganic oxidizing salts which have failed to go into solution. The filtered inorganic oxidizing solution is then delivered by conduit 46 to oxidizer holding tank 48 which is preferably of a slightly larger capacity than oxidizer makeup tank 10. Oxidizer holding tank 48 is also supplied with agitation means 50 and steam coils 52. If necessary, water can be added to the oxidizer holding tank 48 via water meter 54 and water conduit 56. On the other hand, it may be necessary to lower the water content of the aqueous oxidizer solution in order to increase the concentration of inorganic oxidizing salts, and in this case heat can be supplied by steam coils 52 in order to cause evaporation of water from oxidizer holding tank 48.

Oxidizer solution pumping means 58 is preferably a highly accurate metering type pump preferably of the positive displacement diaphragm type. Such pumps are capable of metering rates of flow therethrough at tolerances of about ± 1%. Suitable such pumps are sold by Milton Roy Inc., Philadelphia, Pa. under the trade designation MILROYAL.

Dual filtering means **60*a* and 60*b* provided for a second filtration of the inorganic oxidizing salt solution as it leaves the metering pump means 58. Use of dual filters provides for reduced load on each filter and increased operation time between filter cleansing operations. Furthermore pumping can continue through one filter while the other is being cleaned, thus avoiding shutdown of the process. An accumulator 62 is provided, including pressurized air source 64 and pressure measurement means 66 for the purpose of damping the oscillating pressure pulses which issue from positive displacement diaphragm type metering pump 58. The oxidizing solution travels through feed line 68, which can be surrounded by a hot water jacket 70 supplied with steam or water at a temperature sufficient to keep the inorganic oxidizing solution above its crystallization temperature (about 190 degrees F). Metering means 72 provides for accurate measurement of the flow of the inorganic oxidizing solution through conduit 68 and relief valve 74 provides for the release of over pressure or any excess amounts of inorganic oxidizing solution from the system via drain conduit 76. Rupture disc 78 provides for emergency release of excess flow rates of the inorganic oxidizing salt solution. One-way valve 80 insures that none of the hydrocarbon fuel phase (to be described below) backs up into the oxidizer solution portion of the system and thereby contaminating it. The junction of inorganic oxidizing solution feed line 68 with hydrocarbon fuel component conduit 82 provides for the delivery of the two components to continuous recycle mixer 168** (described below) or its equivalent.

The preparation of the hydrocarbon fuel phase of the water-in-oil explosive compositions produced by the process of the subject invention will now be described with relation to the drawing. The fuel component can also be produced in a production line manner so as to facilitate continuous production of the emulsion explosive compositions on a commercial scale. The carbonaceous fuel component which is useful in preparing such compositions includes most hydrocarbons, for example, paraffinic, olefinic, naphthenic, aromatic, saturated or unsaturated hydrocarbons. In general, the carbonaceous fuel is a water immiscible, emulsifiable fuel which is either liquid or liquefiable at a temperature up to about 200 degrees F, and preferably between about 110 degrees F and 160 degrees F. It is preferable that the carbonaceous fuel include a combination of a wax and an oil. However, waxes are not always necessary. Suitable oils which can be used in the process of the subject invention include petroleum oils, various vegetable oils and various grades of dinitrotoluene; a highly refined mineral oil sold by Atlantic Refining Company under the trade designation ATREOL; a white mineral oil sold under the trade designation KAYDOL by Witco Chemical Company, Inc., and the like. Thus, oil holding tank 84 provides a supply of oil to the system via conduit 86 and oil pumping means 88. Oil is pumped via conduit 90 to fuel makeup tank 92. Normally, the oil component of the carbonaceous fuel can be pumped at ambient temperatures without the necessity for heating the equipment.

As noted above, in a preferred embodiment of the subject invention a mixture of oils and waxes is employed. Suitable waxes which can be employed have melting points of at least 80 degrees F preferably in the range of about 110 to about 200 degrees F. Examples of suitable waxes include waxes derived from petroleum, such as petrolatum wax, microcrystalline wax, and paraffin wax, mineral waxes such as ozocerite and montan wax, animal waxes such as spermacetic wax, and insect waxes such as beeswax and Chinese wax. Preferred waxes include those identified by the trade designations INDRA 1153, INDRA 5055-G, INDRA 4350-E, INDRA 2126-E and INDRA 2119 sold by Industrial Raw Materials Corporation, and a similar wax sold by Mobil Oil Corporation under the trade designation MOBIL 150 as well as WITCO X145-A sold by Witco Chemical Company Inc., and ARISTO 143° sold by Union 76 Co. These waxes can be charged manually, or by automatic conveyor means, to wax melt tank 94, which is supplied with heating means such as steam coils 96, and agitation means 98, to thereby melt the wax and allow it to be pumped via outlet conduit 100, and wax pumping means 102, through conduit 104 to fuel makeup tank 92. Fuel makeup tank 92 is also supplied with heating means such as steam coils 106 so as to maintain the temperature of the oil-wax mixture above its congealing point. Agitating means 108 is provided so as to insure a good mix between oil and wax components. Load cells 110 are used to automatically control the oil pumping means 88 and wax pumping means 102, these pumping means being automatically shut down when a predetermined weight of fuel components have been delivered to fuel makeup tank 92. Fuel outlet conduit 112 and pumping means 114 deliver the fuel component via conduit 116 to fuel holding tank 118 which is also supplied with agitation means 120 and heating means such as steam coils 122. The heating means described above are employed to raise the temperature of the hydrocarbon fuel component to approximately the same temperature as the oxidizing solution described above. Thus when the fuel and oxidizer components are mixed together there will be no cooling off of the oxidizer solution which might result in undesirable crystallization of the inorganic oxidizing salts. Fuel holding tank 118 insures that a ready supply of hydrocarbon fuel component (the oil and wax mixture) of the explosive compositions prepared by the process of the subject invention are ready on a continuous basis for use in the process. Hydrocarbon fuel line 124 delivers the hydrocarbon fuel component to the inlet of a metering fuel pump means 126 which is preferably of the positive displacement diaphragm type described above. Accumulator 128, or an equivalent pulse dampening device, pressure sensing means 130 and an air pressure source provide means for damping the pulsating flow of hydrocarbon fuel component through fuel conduit 134 to melt filter 136. Filtered hydrocarbon fuel component (separated from any congealed solid fuel by the filter) is delivered via conduit 138 which is provided with heating jacket 140. Metering means 142 provides for the controlled flow of the hydrocarbon fuel component through line 82 where it contacts the aqueous inorganic oxidizing salt solution at the intersection of conduits 68 and 82. Between metering means 142 and the intersection of conduits 68 and 82, relief valve means 144 is provided for bleeding off any excess fuel component pressure delivered through meter 142, and rupture disc means 146 is provided for emergency relief of unexpected excesses flowing through line 82. One-way valve means 148 protects the fuel component line from contamination should a backup occur causing the inorganic oxidizing salt solution to flow back up conduit 82.

A suitable emulsifier used to form the emulsion matrix from the aqueous inorganic oxidizing solution and the hydrocarbon fuel components described hereinabove is supplied via emulsifier reserve tank 150 through conduit 152, pumping means 154, and conduit 156 to emulsifier holding tank 158. Emulsifiers useful in the preparation of water and oil explosive emulsions include those derivable from sorbitol by esterification with removal of one molecule of water such as sorbitan, fatty acid esters, for example, sorbitan monolaurate, sorbitan monooleate, sorbitan monopalmitate, sorbitan monostearate, and sorbitan tristearate. Other useful materials comprise mono- and diglycerides of fat-forming fatty acids, as well as polyoxyethylene sorbitol esters, such as polyethylene sorbitol beeswax derivative materials and polyoxyethylene(4) lauryl ether, polyoxyethylene(2) ether, polyxyethylene (2) stearyl ether, polyoxyalkylene oleate, polyoxyalkylene oleyl acid phosphate, substituted oxazolines and phosphate esters and mixtures thereof and the like. Emulsifiers of this general type are delivered via outlet conduit 160 and metering pump means 162, which is preferably of the positive displacement diaphragm type described above, to emulsifier conduit 164 which enters fuel component conduit 82 near the intersection of conduits 82 and 68. It has been discovered that many of the emulsifiers useful in the emulsion explosive compositions of the present invention will tend to degrade with time if exposed to the relatively high processing temperatures of the present invention. Therefore, it has been found to be especially preferable to introduce the emulsifier, at substantially ambient temperatures, at a point just prior to mixing of the fuel component and inorganic oxidizing salt solution to form an emulsion matrix. Of course, the emulsifier could be added directly to the mixer or could be added in conjunction with the inorganic oxidizing salt solution, however, it has been found to be preferred to allow the emulsifier to admix with the fuel component just prior to the admixing of these materials with the inorganic oxidizing salt solution.

The process step of admixing the fuel component with the inorganic oxidizing salt solution will now be described in detail with reference to the drawing. As noted above, the emulsifier preferably enters the fuel component conduit 82 at a point just prior to where conduit 82 joins oxidizing solution conduit 68. The mixture of the inorganic oxidizing solution and fuel component can then be further processed in a single emulsion matrix processing line which basically comprises a continuous recycle mixer, for forming the emulsion matrix, and a blending apparatus for the addition of sensitizing agents, such as microbubbles, the mixer and blender being separated by a detonation trap for safety reasons described below. Thus, the oxidizer solution and fuel mixture is delivered via conduit 166 to a mixing means such as continuous recycle mixer 168. Temperature sensing means 167 and 169, communicating with the inlet and outlet, respectively of continuous recycle mixer 168 provide for monitoring of process conditions within the mixer and can be used as warning devices should the mixer develop mechanical problems. Suitable continuous recycle mixers are available from Chemetron, Inc., sold under the trade name VOTATOR CR MIXER. Basically, a continuous recycle mixer provides for a constant residence time of materials therein but provides for continuous recycling of the materials over a series of intermeshing pins so that the hydrocarbon fuel and oxidizer solution are thoroughly mixed in the presence of the emulsifier. Continuous recycle mixers accomplish this action by means of a multi-vaned impeller sandwiched between two discs. Each of the discs have a series of pins thereon which mesh with pins on the mixer housing. By providing apertures on the discs which cause material in the mixer to be recycled back through the intermeshing pins prior to passage out of the mixer, the recycle mixing action is accomplished. Such action within the mixer provides for extremely good admixture of the fuel component with the inorganic oxidizing component and insures production of a stable emulsion. It has been discovered that operating such a mixer, having an impeller of about 6" in diameter, at rotor speeds of from about 1400 rpm and at pressures within the mixer of from about 35 to about 40 psig, with average residence times of about 4.5 seconds, results in an extremely stable emuslion matrix useful in the production of cap sensitive water-in-oil explosive emulsion compositions. Of course various other operating parameters can be employed, depending upon the particular size of the mixer and the amount of product being processed, but the emulsifying shear rate conditions must be maintained in order to obtain stable emulsions. While continuous recycle mixers have been found to be excellent means for obtaining the recessory emulsifying shear rates other mixers which can be employed include in-line mixers such as those sold under the trade designation TURBON, by Tobert Industries, Inc., Southbridge Mass. or colloid type mixers such as an OAKES mixer sold by E. T. Oakes Corp, Islip, N.Y.

The emulsion explosive matrix formed in mixer 168 is delivered via outlet conduit 170, through detonation trap 172 (described below), to pinch valve means 174. Pressure sensing means 176 is preferably automatically interconnected with pinch valve means 174 to regulate the pressure in mixer 168 so that it falls within the ranges described above in order to produce the stable emulsion matrix within mixer 168. Furthermore, pressure sensing means 176 also provides for the monitoring of the emulsion matrix leaving mixer 168 via conduit 170 to insure that the mixture is emulsified to the desired extent. If the emulsion should "break", that is, if the aqueous oxidizer solution failed to become emulsified into discrete globules contained within a continuous oil phase, the pumping characteristics of the matrix flowing through outlet conduit 170 will change drastically causing a reduction in pressure sensed by pressure sensing means 176. Thus, either through manual inspection or by automatic means, pressure sensing means 176 will indicate that undesirable "broken" mixtures of the aqueous oxidizer solution and the fuel components are exiting from mixer 168. Appropriate remedial action can then be taken manually, or automatically, to avoid contamination of down-line product, for example by controlling pinch valve 174.

Detonation trap 172 basically comprises a flexible conduit which has been discovered to prevent a conflagration initiating in the mixer 168 or conduit 170 from propagating therethrough and reaching the continuous blender described below. Basically, the detonation trap 172 can be manufactured from any of a number of chemically inert elastomeric substances which are capable of withstanding the pressures and temperatures employed in the process, as well as the chemical action of the emulsion matrix passing therethrough. For example, in a process wherein the flow rate through conduit 170 is about 50 lbs./minute a flexible piece of tubing approximately 18" in length having an internal diameter of 1½" and manufactured from rubber, polyethylene or a composite of these and similar materials can be used as the detonation trap of the present invention. A typical hose used for this purpose is sold under the trade designation FLEXWING by Goodyear Tire and Rubber Co. of Akron, Ohio which comprises a polyethylene tube and reinforced rubber cover with spiral wire helix between braided synthetic yarn.

The emulsion matrix passes via pinch valve 174 into conduit 178 and into continuous blender 180. Continuous blender 180 provides for the admixture of the emulsion matrix with closed cell void containing materials such as glass or resin microbubbles. Glass microbubbles are preferred. Particulate metal fuels, and the like, such as particulate aluminum, for example, can also be added and thoroughly admixed with the emulsion matrix in continuous blender 180. Continuous blender 180 preferably comprises any of a number of continuous blenders of the paddle type such as those sold by Sprout Waldon Co., Day Mixing Co. and Cleveland Mixer, Co., although other types of blenders, including ribbon type blenders, for example, can be employed.

The microbubbles are added to the system via vacuum line 182 which sucks microbubbles from a storage barrel or other container 184. This method of feed provides for minimizing the dispersion of microbubbles in the air so as to avoid health hazards. Vacuum line 182 delivers the microbubbles to microballoon hopper 184. It has been discovered that because of the fine particulate nature of the microbubbles the flow characteristics of a quantity thereof is highly dependent upon how long they have been allowed to settle after transportation via a vacuum source whereby air is intermixed therewith. Thus, microbubbles which have been transported and admixed with air have flow characteristics very similar to those of water and will pour, at rates which are hard to control, into the feeder mechanisms for the blender 180. This condition is very undesirable as close control of the amount of microbubbles being admixed with the emulsion matrix is critical if quality products are to be attained. Therefore, it has been discovered that microbubble hopper 184 should provide for a residence time of at least 4 minutes to thereby allow the microbubbles to deaerate and become packed within the hopper 184. However, once the microbubbles deaerate and settle within the hopper, their flow characteristics become similar to those of normal solid materials and flow out of the hopper will not proceed at an even rate under gravitational force alone. Therefore, a screw feed mechanism 186, such as a Soder prefeed screw mechanism sold by the KTron Corporation, can be employed to feed the microbubbles from hopper 184 to a weight-belt type of feed mechanism 188. The screw feeder must be of the dual screw type having meshing flights such that the flow of the microbubbles therealong can be controlled. The weight-belt can be those sold under the trade name KTRON by KTron Corporation, Glasboro, N.J. The weigh-belt mechanism 188, in conjunction with the screw feed mechanism 186, can be employed to deliver a closely controlled quantity of microbubbles to the continuous blender 180. The amount of microbubbles can be controlled either on the basis of volume or on the basis of weight, as desired. This feature is especially desirable since the density of a selected grade of microbubbles may vary widely. For example microbubbles listed as having a density of "0.15/cc" may vary between about 0.12 and 0.18 g/cc. Therefore, if the final end product is desired to have a specified total weight percent of microbubbles, the weigh-belt feed mechanism 188 can be employed to deliver a known quantity of microbubbles to the continuous blender 180 based on the flow rate of the emulsion matrix into mixer 180 via conduit 178. On the other hand, if a controlled density product is desired, the screw feed mechanism 186 can be employed to provide for specific volumetric additions of microballoons to weigh feed belt feeder mechanism 188 (which in that case merely acts as a conveyor belt), and then to blender 180, to provide for the production of a product having known density characteristics.

The finished water-in-oil explosive compositions exit blender 180 via exit conduit 190, and screen 192 and are delivered to packaging apparatus where the emulsions can be packaged as desired, for example, in cardboard or paper cartridges, plastic bags and the like.

While this invention has been described in relation to its preferred embodiments it is to be understood that various modifications thereof will now be apparent to one skilled in the art upon reading this specification and it is intended to cover all such modifications as fall within the scope of the appended claims.

I claim:

1. A process for producing explosive emulsion compositions sensitized with microbubbles comprising:

(a) forming an aqueous inorganic oxidizing salt solution of at least about 64% by weight inorganic oxidizing salts and maintaining said solution above the crystallization temperature thereof;

(b) forming a hydrocarbon fuel component and heating it to approximately the same temperature as said oxidizing solution;

(c) introducing said oxidizer solution, said hydrocarbon fuel component, and an emulsifier to a mixing zone and mixing at conditions sufficient to obtain emulsifying shear rates to thereby form an emulsion matrix, said emulsifier being added in a manner such that the time of contact with the heated oxidizer solution and hydrocarbon fuel component is not sufficient to cause said emulsifier to degrade prior to the formation of said emulsion matrix; and (d) blending with said emulsion matrix a predetermined quantity of microbubbles delivered from a deaerated supply thereof to form explosive emulsion.

2. The process of claim 1 wherein said oxidizing salt solution is maintained at a temperature of about 187 degrees F.

3. The process of claim 1 and further comprising blending with said emulsion matrix a particulate metal.

4. The process of claim 3 wherein said particulate metal is particulate aluminum.

5. The process of claim 1 and further comprising filtering said aqueous inorganic salt solution and said hydrocarbon fuel component prior to introduction into said mixing means.

6. The process of claim 1 wherein said emulsifier is added to said hydrocarbon fuel component and dispersed therein at a point prior to introduction of said hydrocarbon fuel component to said mixing means.

7. The process of claim 1 wherein said microbubbles are delivered from said deaerated supply thereof for blending with said emulsion matrix on the basis of a predetermined weight percent of microbubbles, based on the weight of the explosive emulsion.

8. The process of claim 1 wherein said microbubbles are delivered from said deaerated supply thereof for blending with said emulsion matrix on the basis of a predetermined volume thereof to obtain explosive emulsions of a predetermined density.

9. The process of claim 1 wherein said mixing means is a continuous recycle mixer.

10. A process for producing cap sensitive water-in-oil explosive emulsion compositions sensitized with microbubbles comprising:

(a) filling an oxidizer solution holding tank with an aqueous solution of inorganic oxidizing salts comprising at least about 67% of weight of said inorganic oxidizing salts and maintaining said solution at a temperature above about 187 degrees F;

(b) filling a fuel component holding tank with a quantity of hydrocarbon fuel component and heating said hydrocarbon fuel component to substantially the same temperature as said oxidizer solution;

(c) simultaneously passing controlled proportions of said oxidizing component and said fuel component to a mixing zone, adding an emulsifier to said fuel component at a point just prior to said mixing zone such that said emulsifier is not degraded from contact with said heated hydrocarbon fuel;

(d) mixing said oxidizer solution, hydrocarbon fuel, and emulsifier components in said mixing zone at conditions sufficient to obtain emulsifying shear rates to form an emulsion matrix; and (e) blending with said emulsion matrix a predetermined quantity of microbubbles to thereby form said cap sensitive water-in-oil composition.

11. The process of claim 10 and further comprising blending with said emulsion matrix a predetermined amount of a particulate metallic fuel component.

12. The process of claim 11 wherein said particulate metallic fuel component is particulate aluminum.

* * * * *

UNITED STATES PATENT AND TRADEMARK OFFICE

CERTIFICATE OF CORRECTION

PATENT NO. : 4,138,281

DATED : February 6, 1979

INVENTOR(S) : Robert S. Olney, et al.

It is certified that error appears in the above–identified patent and that said Letters Patent are hereby corrected as shown below:

Abstract, line 7, change "coposition" to --composition--.

Col. 1, line 21, change "emlsion" to --emulsion--.

Col. 2, line 60, change "particulare" to --particulate--.

Col. 8, line 8, change "emuslion" to --emulsion--.

Col. 9, line 44, change "weight" to --weigh--;
line 48, change "weight-belt" to --weigh-belt--.

Col. 11, line 3 (Claim 10), change "67% of" to --67% by--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,138,281

DATED : February 6, 1979

INVENTOR(S) : Robert S. Olney, et al.

It is certified that error appears in the above-identified patent and that said Letters Patent are hereby corrected as shown below:

On page 1 of the patent after lines "[76]" and before line "[21]" insert --[73] Assignee: Atlas Powder Company, Dallas, Tex.--

Signed and Sealed this

*Twenty-fourth* Day of *June 1980*

[SEAL]

*Attest:*

SIDNEY A. DIAMOND

*Attesting Officer*

*Commissioner of Patents and Trademarks*